United States Patent [19]

Morii et al.

[11] Patent Number: 4,982,676

[45] Date of Patent: Jan. 8, 1991

[54] POCKET CLOTH FOLDING DEVICE OF A POCKET SETTER

[75] Inventors: Satoshi Morii, Nagoya; Hiroyuki Mitsui, Kasugai; Toshiaki Iwasaki, Nagoya, all of Japan

[73] Assignee: Brother Kogyo Kabushiki Kaisha, Nagoya, Japan

[21] Appl. No.: 523,363

[22] Filed: May 15, 1990

[30] Foreign Application Priority Data

May 23, 1989 [JP] Japan ..... 1-59537[U]

[51] Int. Cl.[5] ..... D05B 21/00; D05B 35/00

[52] U.S. Cl. ..... 112/121.15; 112/147; 112/DIG. 3; 223/38

[58] Field of Search ..... 112/121.15, 121.12, 112/147, 104, 265.1, DIG. 3; 223/38

[56] References Cited

U.S. PATENT DOCUMENTS 4,493,276 1/1985 Sadeh ..... 223/38 X 4,821,659 4/1989 Morii et al. ..... 112/121.15

FOREIGN PATENT DOCUMENTS 6391275 12/1986 Japan .

1309937 3/1973 United Kingdom .

*Primary Examiner*—Peter Nerbun

*Attorney, Agent, or Firm*—Oliff & Berridge

[57] ABSTRACT

A pocket cloth folding device of a pocket setter in which a flow controller is provided on a folding-pieces support member such that the amount of working fluid through a fluid pressure driver for movement of the folding-pieces support member is controlled. The flow controller is constructed to be connected to either a flow supply path or a flow exhaust path via connectors. The flow amount of the flow controller is regulated in advance according to the type of the folding-pieces support member. Therefore, the pocket cloth folding device can fold the peripheral edge of the pocket cloth, immediately after the folding-pieces support member is attached to support blocks. The amount of supply air and exhaust air of the fluid pressure driver does not need to be adjusted each time a different type of pocket cloth is to be folded.

7 Claims, 2 Drawing Sheets

POCKET CLOTH FOLDING DEVICE OF A POCKET SETTER

BACKGROUND OF THE INVENTION

This invention relates to a pocket cloth folding device of a pocket setter.

As a method for forming a fold along the peripheral edge of a pocket cloth, Japan Published Unexamined Utility Model Application No. S63-91275 is known. FIG. 2 depicts a pocket cloth folding device of this related-art method. On a table 4 a vertically movable base 10 is provided. A support plate 14 is slidably supported by the base 10 via a cylinder 11, and a support shaft 16 is laid between two projections of the base 10. A press-plate holder 18 and support blocks 30 are movably supported on the support shaft 16. A press plate 19 is detachably connected to the lower ends of the press-plate holder 18, and a piston 22 of an air cylinder 21 is connected to the upper end of the press-plate holder 18. The end of the air cylinder 21 is rotatably provided on the upper surface of the base 10. When the piston 22 of the air cylinder 21 is actuated to extend, the press plate 19 is moved to a pressing position for pressing a pocket cloth placed on the support plate 14. Then, a bending edge 191 formed on the periphery of the press plate 19 bends down the peripheral edge of the pocket cloth. On the contrary, when the piston 22 of the air cylinder 21 is actuated to withdraw, the press plate 19 is shifted to a detached position away from the support plate 14.

A folding-pieces support member 24 having a central space 100 is detachably attached to the lower ends of the support blocks 30. The inside peripheral edge of the folding-pieces support member 24 is in parallel with the outside peripheral edge of the support plate 14. Pistons 29 of air cylinders 28 are rotatably connected to the upper ends of the two support blocks 30 respectively, and the air cylinders 28 are also rotatably connected to both side projections of the base 10. When the pistons 29 of the air cylinders 28 extend, the folding-pieces support member 24 is set at an operational position surrounding the support plate 14. When the pistons 29 withdraw, the folding-pieces support member 24 is shifted to be at a preparatory position above the support plate 14.

On the folding-pieces support member 24, four air cylinders 25 having pistons 26 are provided, to which folding pieces 27 are fixed, respectively. The folding pieces 27 are also shifted between two positions, namely, a projecting position and a withdrawn position when the folding pieces support member 24 is at the operational position. At the projecting position, the folding pieces 27 are set under the support plate 14 by the air cylinder 25 such that the bent peripheral edge of the pocket cloth is folded to the underside of the support plate 14. After the folding operation, the folding pieces 27 are shifted back to the withdrawn position.

In order to sew a pocket cloth on a front cloth with the above-mentioned pocket cloth folding device, an operator places the pocket cloth on the support plate 14 in the state that the base 10 is at an upper position and the support plate 14 is at the projecting position. Then, the press plate 19 is rotated to the pressing position, and the folding-pieces support member 24 is also rotated from the preparatory position to the operational position. Further, the folding pieces 27 are shifted from the withdrawn position to the projecting position so as to fold the peripheral edge of the pocket cloth to the underside of the support plate 14.

Subsequently, the base 10 is moved to a lower position, and the support plate 14, the press plate 19 and the folding-pieces support member 24 are all together lowered onto the front cloth placed on the table 4. Then, the folding pieces 27 are shifted back to the withdrawn position, the folding-pieces support member 24 is rotated to the preparatory position, and the press plate 19 is also rotated to the detached position.

After these operations are finished, a clamp plate 9 is actuated to be positioned above the pocket cloth and presses the pocket cloth onto the body cloth. Then the support plate 14 is slid back by the air cylinder 11 and the base 10 is raised to the upper position The clamp plate 9 pressing the pocket cloth and the front cloth is positioned under the sewing machine head 2. Thus the pocket cloth is sewn on the front cloth.

However, the prior-art pocket cloth folding device has the following problems:

Since the folding-pieces support member 24 is connected to the support blocks 30 only at two ends as a cantilever plate, the free end on which the folding pieces 27 are provided tends to vibrate when the folding-pieces support member 24 is rotated from the preparatory position to the operational position. Under such a condition, the folding pieces 27 may crush against the support plate 14 or the like, thus being damaged.

The speed of the movement of the air cylinders 28 should be accelerated in order to shorten the cycle time from the beginning of the folding operation of the pocket cloth to the end of the sewing operation of the pocket cloth on the front cloth. Consequently, a larger amount of more highly pressured air should be supplied to the air cylinders 28.

To solve these problems in the prior-art pocket cloth folding device, the amount of air flowing into and out of the air cylinders 28 is set such that the vibration of the folding-pieces support member 24 is not excessive. A flow control valve provided in the vicinity of the base 10 controls the amount of the air.

Yet, at sewing factories, a variety of folding-pieces support members 24 are utilized according to pocket cloths of various sizes and shapes. Each time a different type of the pocket cloth is sewn, the flow control valves have to be regulated to fit the weight of the folding-pieces support member 24 corresponding to the pocket cloth to be sewn.

SUMMARY OF THE INVENTION

It is an object of the present invention to provide a pocket cloth folding device of a pocket setter which can fold peripheral edges of a variety of pocket cloths without a need to adjust the amount of working fluid flowing into and out of a fluid pressure driver such as an air cylinder for actuating a folding-pieces support member.

This object is realized by a pocket cloth folding device of a pocket setter which comprises a flow controller provided on the folding-pieces support member and connected to one of a fluid supply path and a fluid exhaust path via connectors. The flow controller controls the flow amount of working fluid through a fluid pressure driver for moving a folding pieces support member between an operational position and a preparatory position. When a different type of pocket is to be sewn, a corresponding folding-pieces support member is inserted and connected to support blocks. Then the flow controller, which is adjusted in advance, is connected to the flow supply path or the flow exhaust path, via connectors, of the fluid pressure driver for controlling the folding-pieces support member. Thus, the fluid pressure driver is actuated by an appropriate amount of the working fluid.

BRIEF DESCRIPTION OF THE DRAWINGS

By way of example and to make the description more clear, reference is made to the accompanying drawings in which.

DETAILED DESCRIPTION OF THE PREFERRED EMBODIMENT

Set forth is an explanation of a preferred embodiment of the present invention with reference to the attached drawings.

Figure 2:
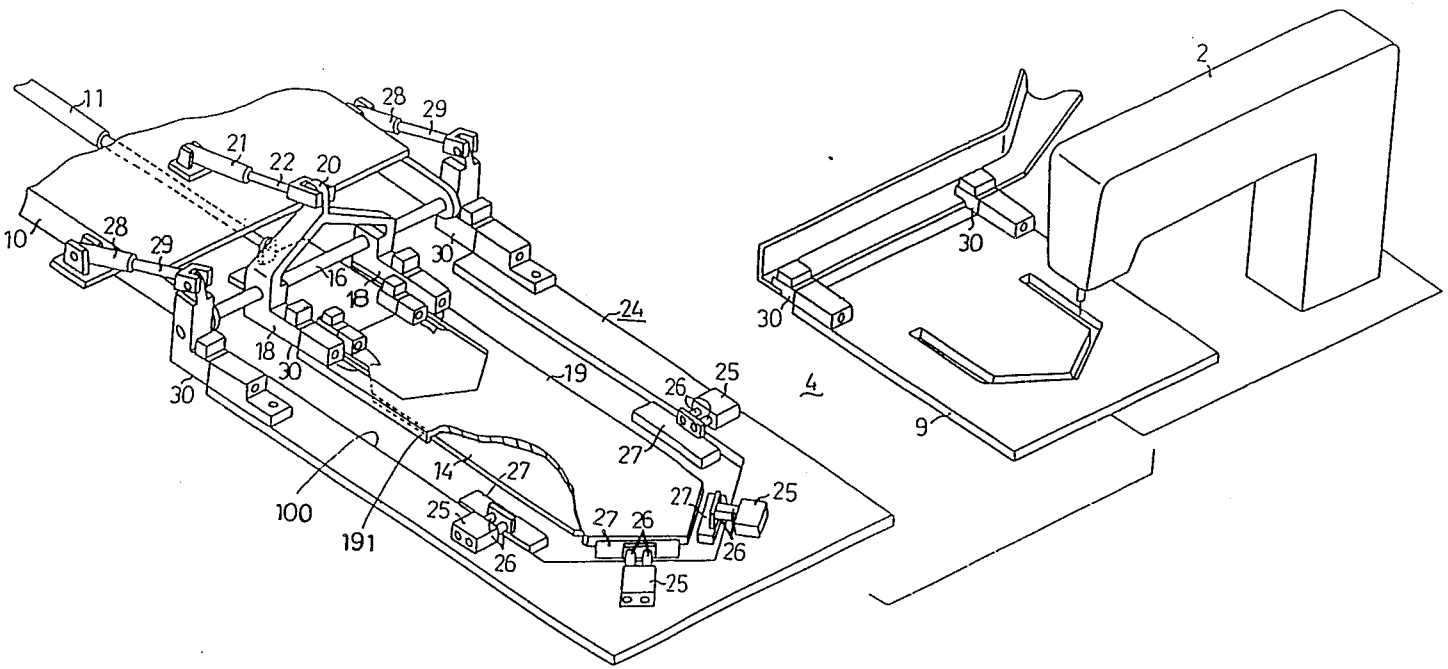
FIG. 2 is a perspective view of a prior-art pocket cloth folding device for a pocket setter.

The main construction of a pocket cloth folding device of a pocket setter of the present invention is identical to the construction of the prior-art pocket cloth folding device shown in FIG. 2. Therefore, the explanation of the construction is omitted, and detailed description is given to a supply path and an exhaust path of compressed air, which is the working fluid of air cylinders 28 used as fluid pressure drivers.

Figure 1:
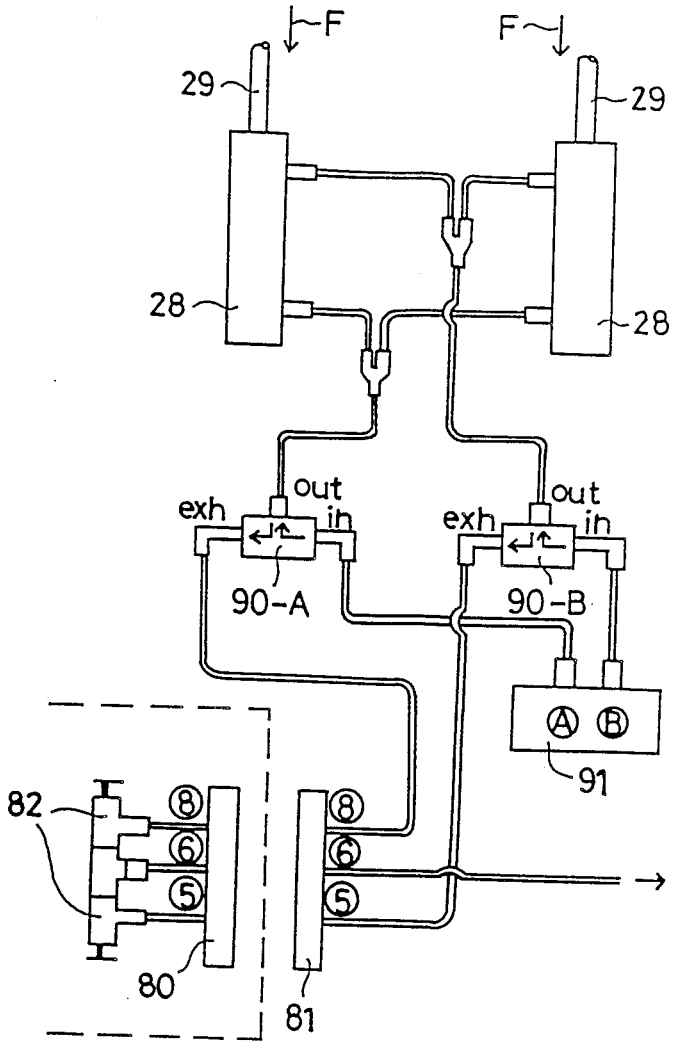
FIG. 1 is a circuit diagram of air flow through air cylinders for actuating a folding-pieces support member of an embodiment of the present invention.

The air cylinders 28 are actuated via an electromagnetic valve 91 by compressed air from a compressed air supply connected to either a port A or a port B, as shown in FIG. 1. When the compressed air supply is connected to the port B, the compressed air from the port B flows through a port-in and a port-out of a quick exhaust 90-B, thus withdrawing pistons 29 of the air cylinders 28 in a direction F. Then, a folding-pieces support member 24 is positioned at a preparatory position above a support plate 14. On the other hand, since the port A is set at atmospheric pressure, an exhaust air is discharged through a port-out and a port-ex of a quick exhaust 90-A, a No. 8 port of a multiconnector 81, a No. 8 port of a multiconnector 80 provided on the folding-pieces support member 24, a restrictor 82 as a flow controller, a No. 6 port of the multiconnector 80, and a No. 6 port of the multiconnector 81.

When the compressed air supply is connected to the port A via the electromagnetic valve 91, the compressed air from the port A flows through the port-in and the port-out of the quick exhaust 90-A. Since the port B is set at atmospheric pressure, the exhaust air is discharged through the port-out and the port-exh of the quick exhaust 90-B, a No. 5 port of the multiconnector 81, a No. 5 port of the multiconnector 80 of the folding-pieces support member 24, the flow controller 82, the No. 6 port of the multiconnector 80, and the No. 6 port of the multiconnector 81. Then the pistons 29 of the air cylinders 28 project in the opposite direction to the direction F shown in FIG. 1 and the folding-pieces support member 24 is lowered to the operational position surrounding the support plate 14.

As described above, in the projecting and withdrawn movement of the pistons 29 of the air cylinders 28, the compressed air discharged from the air cylinders 28 will always pass through one of the pair of restrictors 82. The air cylinders 28 are actuated by a predetermined amount of compressed air and the air exhausted from cylinders 28 is regulated by the flow controller 82. The flow-controller 82 provided on the folding-pieces support member 24 is adjusted beforehand such that the folding-pieces support member 24 does not vibrate when shifted from the preparatory position to the operational position. After the folding-pieces support member 24 suitable for a different type of a pocket cloth is attached to the support blocks 30, the sewing machine can immediately begin the folding operation of the pocket cloth.

The multiconnectors 80 and 81 are provided with No. 1 through No. 12 ports, respectively, and the ports other than No. 5, No. 6 and No. 8 ports are utilized for pipe arrangement of air cylinders 25 moving folding pieces 27. The present pocket cloth folding device is superior in that the multiconnectors 80 and 81 are detachable and the folding-pieces support member 24 can be replaced with other types of folding-pieces support members without tedious operation to adjust the flow controller 82.

It should be understood that the present invention is not limited to the above-mentioned embodiment and that modification and variation of the invention are possible in light of the above teaching.

What is claimed is:

1. A pocket cloth folding device of a pocket setter, comprising:

a base;

a support plate on which a pocket cloth is placed, the support plate being supported by the base;

a press plate attached to the base for pressing the pocket cloth on the support plate;

a folder support member detachably and rotatably attached to the base such that the folder support member rotates between an operational position and a preparatory position, where the folder support member surrounds the press plate when the folder support member is in the operational position;

a fluid pressure driver attached to the base for rotating the folder support member between the preparatory and the operational positions;

a plurality of folders mounted on the folder support member that shift between a projecting position and a withdrawn position, where, when the folder support member is in the operational position, the folders fold the bent edge of the pocket cloth to the underside of the support plate when the folders shift to the projecting position; and a fluid pressure driver actuating system comprising:

a fluid pressure source connected to the fluid pressure driver for causing the fluid pressure driver to rotate the folder support member between the preparatory position and the operational position and a fluid flow controller detachably connected to the fluid pressure driver for regulating the flow of the fluid exhausted from the fluid pressure driver; wherein the fluid flow controller is mounted on the folder support member and an amount by which the fluid flow controller regulates the flow of the fluid exhausted from the fluid pressure driver is predetermined according to the folder support member on which the fluid flow controller is mounted.

2. The pocket cloth folding device of claim 1, in which any one of a plurality of different folder support members may be attached to the base, where each folder support member has a fluid flow controller mounted thereon and the amount by which each fluid flow controller regulates the flow of fluid exhausted from the fluid pressure driver is predetermined according to the folder support member on which the fluid flow controller is mounted.

3. The pocket cloth folding device of claim 2, in which the fluid pressure driver defines first and second chambers, where the fluid pressure driver rotates the folder support member to the preparatory position when pressurized fluid is supplied to the first chamber and rotates the folder support member to the operational position when pressurized fluid is supplied to the second chamber.

4. The pocket cloth folding device of claim 3, in which the fluid pressure driver actuating system further comprises:

means for connecting the second chamber to the fluid flow controller when the first chamber is connected to the fluid pressure source; and means for connecting the first chamber to the fluid flow controller when the second chamber is connected to the fluid pressure source.

5. The pocket cloth folding device of claim 4, in which:

the fluid flow controller further comprises first and second fluid flow controllers; and the fluid pressure driver actuating means further comprises means for exhausting the fluid from the first chamber to the first fluid flow controller and means for exhausting the fluid from the second chamber to the second fluid flow controller.

6. A pocket cloth folding device of a pocket setter, comprising:

a base;

a support plate on which a pocket cloth is placed, the support plate being supported by the base;

a press plate rotatably attached to the base such that the press plate rotates between a pressing position for pressing the pocket cloth on the support plate and bending down the edge of the pocket cloth and a detached position away from the support plate;

support blocks rotatably attached to the base;

a folder support member detachably attached to the support blocks such that the folder support member rotates between an operational position and a preparatory position, where the folder support member defines a central space that accommodates the press plate when the folder support member is in the operational position;

a pair of fluid pressure drivers attached to the base and the support blocks for rotating the folder support member between the preparatory and the operational positions, where each fluid pressure driver defines first and second chambers and the first chambers of each fluid pressure driver are connected and the second chambers of each fluid pressure driver are connected;

a plurality of folders mounted on the folder support member that shift between a projecting position and a withdrawn position, where, when the folder support member is in the operational position, the folders fold the bent edge of the pocket cloth to the underside of the support plate when the folders shift to the projecting position; and a fluid pressure driver actuating system comprising:

a fluid pressure source, a pair of first and second fluid flow controllers for regulating the flow of the fluid exhausted from the fluid pressure drivers, where the fluid flow controllers are mounted on the folder support member and the amount by which the fluid flow controllers regulate the flow of fluid exhausted from the fluid pressure drivers is predetermined according to the folder support member on which the pair of fluid flow controllers are mounted, and porting means for selectively connecting either the fluid pressure source to the first chambers and the second chambers to the second fluid flow controller or the fluid pressure source to the second chambers and the first chambers to the first fluid flow controller; wherein when the fluid pressure source is connected to the first chambers, the fluid pressure driver rotates the folder support member from the preparatory position to the operational position; and when the fluid pressure source is connected to the second chambers, the fluid pressure driver rotates the folder support member from the operational position to the preparatory position.

7. The pocket cloth folding device of claim 1, in which any one of a plurality of different folder support members may be attached to the support blocks, where each folder support member has a pair of fluid flow controllers mounted thereon and the amount by which each pair of fluid flow controllers regulates the flow of fluid exhausted from the fluid pressure driver is predetermined according to the folder support member on which the fluid flow controller is mounted.

* * * * *